US008517575B2

(12) United States Patent
Arai

(10) Patent No.: US 8,517,575 B2
(45) Date of Patent: Aug. 27, 2013

(54) ILLUMINATION DEVICE

(75) Inventor: Takafumi Arai, Sanda (JP)

(73) Assignee: Panasonic Corporation, Osaka (JP)

( * ) Notice: Subject to any disclaimer, the term of this patent is extended or adjusted under 35 U.S.C. 154(b) by 62 days.

(21) Appl. No.: 13/050,158

(22) Filed: Mar. 17, 2011

(65) Prior Publication Data

US 2011/0235343 A1 Sep. 29, 2011

(30) Foreign Application Priority Data

Mar. 29, 2010 (JP) ..... 2010-075704

(51) Int. Cl.
*F21V 29/00* (2006.01)

(52) U.S. Cl.
USPC ..... 362/373; 362/184

(58) Field of Classification Search
USPC ..... 362/373, 184
See application file for complete search history.

(56) References Cited

U.S. PATENT DOCUMENTS

| | | | | |
|---|---|---|---|---|
| 7,665,864 | B2 * | 2/2010 | Zheng et al. | 362/249.11 |
| 7,758,211 | B2 * | 7/2010 | Zheng et al. | 362/249.02 |
| 7,922,372 | B2 * | 4/2011 | Li | 362/373 |
| 7,976,179 | B2 * | 7/2011 | Chu | 362/183 |
| 8,113,687 | B2 * | 2/2012 | Villard et al. | 362/249.01 |
| 8,172,422 | B2 * | 5/2012 | Kim | 362/234 |
| 8,235,563 | B2 * | 8/2012 | Zheng | 362/373 |
| 2004/0196653 | A1 | 10/2004 | Clark et al. | |
| 2006/0250803 | A1 | 11/2006 | Chen | |
| 2009/0034257 | A1 | 2/2009 | Liu et al. | |
| 2009/0073681 | A1 | 3/2009 | Chen | |
| 2009/0168416 | A1 | 7/2009 | Zhang et al. | |
| 2009/0213588 | A1 | 8/2009 | Manes | |
| 2009/0237931 | A1 * | 9/2009 | Liu et al. | 362/240 |
| 2009/0244927 | A1 * | 10/2009 | Liu et al. | 362/656 |

FOREIGN PATENT DOCUMENTS

| | | |
|---|---|---|
| CN | 101 101 098 A | 1/2008 |
| CN | 201100565 | 8/2008 |
| JP | 2007242258 | 9/2007 |
| KR | 10-2009-0093492 A | 9/2009 |

OTHER PUBLICATIONS

Office Action issued on Sep. 27, 2012 in corresponding Chinese application No. 2011 10075551.0.
Search Report dated Feb. 8, 2013 issued in corresponding European application No. 1100 2464.3-2423.
Office Action dated May 29, 2013 issued in corresponding Chinese application No. 201110075551.0.

* cited by examiner

*Primary Examiner* — David J Makiya
(74) *Attorney, Agent, or Firm* — Bacon & Thomas, PLLC

(57) ABSTRACT

An illumination device includes: a main body supported by a support member; an upper cover portion for covering an upper portion of the main body; and an LED light emitting part and a power supply unit, both of which are fixed to a lower side of the upper cover portion. The upper cover portion has a plurality of radiation fins provided on a top portion thereof and a plurality of grooves defined between the adjacent radiation fins, the grooves being inclined downward toward a peripheral edge of the upper cover portion.

4 Claims, 7 Drawing Sheets

ILLUMINATION DEVICE

FIELD OF THE INVENTION

The present invention relates to an illumination device installed in outdoor areas.

BACKGROUND OF THE INVENTION

In a conventional illumination device (lamp) used in outdoor areas, radiation fins are usually not employed because they deteriorate water drainage or become a cause of dirt accumulation (see, e.g., JP2007-242258A, claim 1, FIGS. 1, 3 and 4, paragraphs 0012, 0013 and 0015).

However, the conventional illumination device without radiation fins is problematic in heat radiation and, therefore, the lifespan of a lamp such as an LED or the like becomes short. If radiation fins are employed as a solution to these problems, water or other material is gathered in the grooves between the radiation fins. This poses a problem in that the illumination device undergoes corrosion.

SUMMARY OF THE INVENTION

In view of the above, the present invention provides an illumination device of which heat radiation and water drainage are improved.

In accordance with an aspect of the present invention, there is provided an illumination device, including: a main body supported by a support member; an upper cover portion for covering an upper portion of the main body; and an LED light emitting part and a power supply unit, both of which are fixed to a lower side of the upper cover portion, wherein the upper cover portion includes a plurality of radiation fins provided on a top portion thereof and a plurality of grooves defined between the adjacent radiation fins, the grooves being inclined downward toward a peripheral edge of the upper cover portion.

The main body is preferably arranged to slant downward toward the support member and the radiation fins extend toward the support member.

The LED light emitting part may be arranged away from the support member.

With the illumination device of the present invention, it is possible to improve water drainage and heat radiation.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

An illumination device in accordance with an embodiment of the present invention will be described with reference to the accompanying drawings which form a part hereof.

(First Embodiment)

Figure 1:
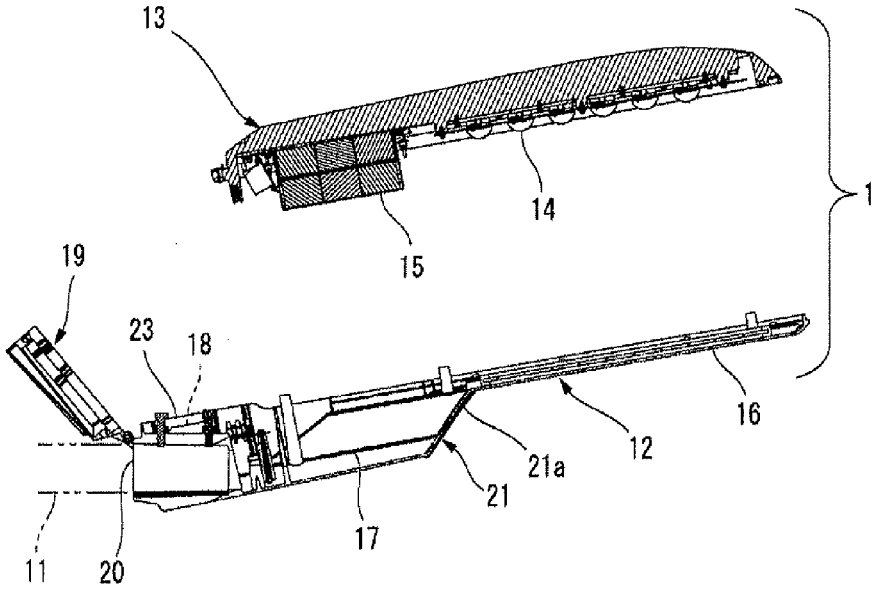
FIG. 1 is an exploded view showing an illumination device in accordance with a first embodiment of the present invention.
Figure 2:
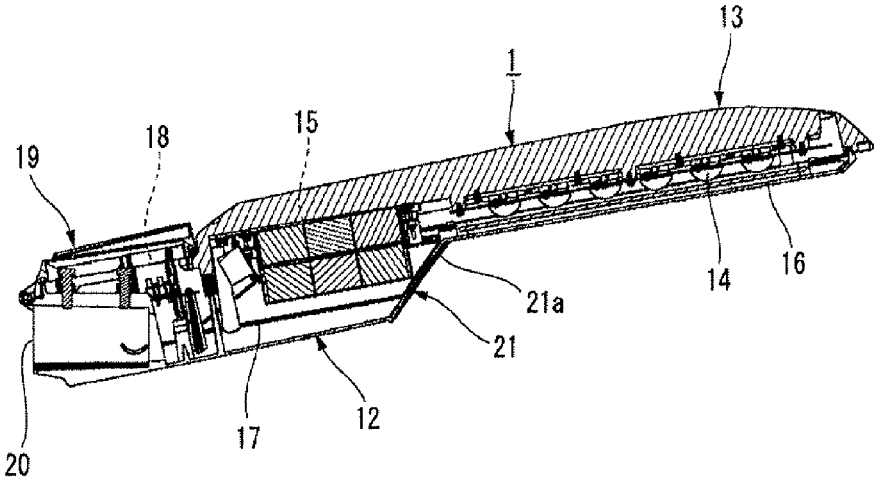
FIG. 2 is an assembled view showing the illumination device.

FIG. 1 is an exploded view showing an illumination device 1 in accordance with a first embodiment of the present invention. FIG. 2 is an assembled view thereof.

The illumination device 1 includes a main body 12 attached to and supported by an arm 11 as a support member, an upper cover portion 13 for covering the upper portion of the main body 12, an LED light emitting part 14 and a power supply block 15 as a power supply unit, both of which are provided at a lower side of the upper cover portion 13, a light emitting panel 16 provided at a lower side of the main body 12 to transmit the light coming from the LED light emitting part 14 and a power supply block containing unit 17 protruding downward from the main body 12 to contain the power supply block 15 therein.

Figure 4:
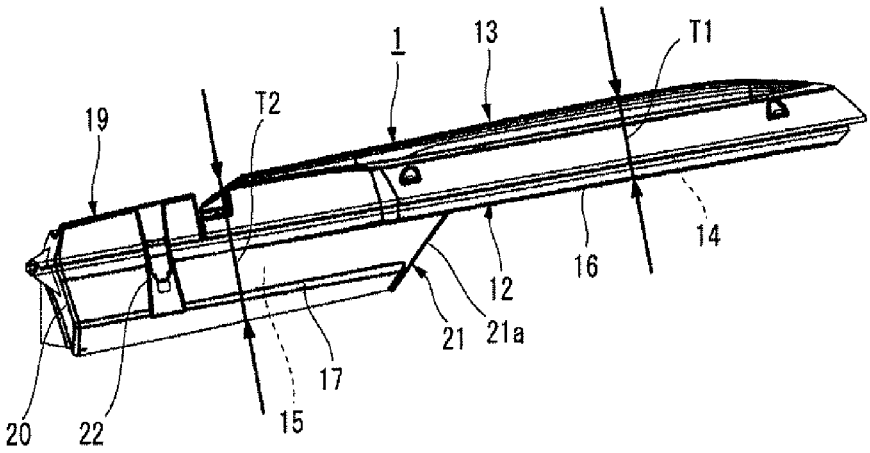
FIG. 4 is a view depicting the thickness of the power supply block area and the thickness of the LED light emitting part area in the illumination device.

As will be described later, the thickness T1 of the section of the illumination device 1 where the LED light emitting part 14 exists is set smaller than the thickness T2 of the section of the illumination device 1 where the power supply block 15 exists (see FIG. 4). A light control function unit 21 having a function of controlling the light coming from the light emitting panel 16 is provided on the outer surface of the power supply block containing unit 17. The power supply block 15 is arranged near the arm 11. A wire-connecting space 18, in which electric wires leading from the outside are connected to the power supply block 15, is provided in the main body 12 near the arm 11. The wire-connecting space 18 is opened and closed by a covering member 19.

A plurality of radiation fins 23 (see FIG. 6) is provided in the top portion of the upper cover portion 13. The radiation fins 23 extend toward the arm 11 in the longitudinal direction of the upper cover portion 13. Grooves 23*a* defined between the adjacent radiation fins 23 are inclined downward toward the peripheral edge of the upper cover portion 13. Further, the main body 12 can be arranged to slant downward toward the arm 1. The LED light emitting part 14 is arranged away from the arm 11.

Next, description will be made on the respective components of the illumination device 1. The wire-connecting space 18 and the covering member 19 are provided on the opposite side to the light emitting panel 16 in the main body 12. An arm insertion portion 20 for insertion of the arm 11 is provided at the lower side of the wire-connecting space 18.

Figure 3:
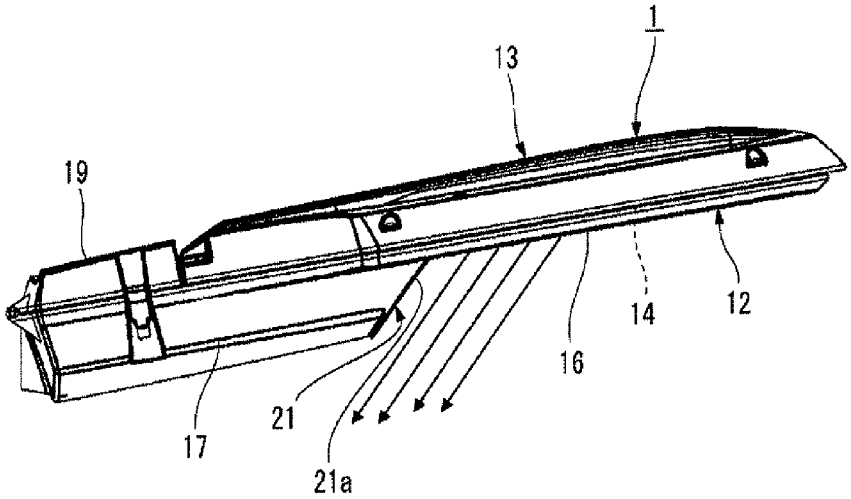
FIG. 3 is a cross sectional view showing a light control function unit in the illumination device.

The power supply block containing unit 17 and the power supply block 15 contained therein are provided near the arm insertion portion 20. Thus, the power supply block is arranged near the arm 11. Alternatively, the power supply block 15 may be arranged on the opposite side to the arm 11. As shown in FIG. 3, the light control function unit 21 serves to control the light coming from the light emitting panel 16. Examples of the light control function include reflection, absorption and oblique cutting of light.

In the present embodiment, the light control function unit 21 is provided on the outer surface of the end portion of the power supply block containing unit 17 which is near the light emitting panel 16. The light control function unit 21 includes a slant surface 21*a* inclined downward in a direction away from the light emitting panel 16. The light coming from the light emitting panel 16 can be controlled by changing, e.g., the shape of the slant surface 21*a* or the coating on the slant surface 21*a*.

In the present embodiment, as can be seen in FIG. 3, the slant surface 21*a* is configured not to reflect the light coming from the light emitting panel 16 so that the light coming from the light emitting panel 16 does not interfere with the light reflected from the slant surface 21*a*. In this regard, it is possible to control the light in a desired manner and to realize a desired light distribution by changing the inclination angle or the coating of the slant surface 21*a* slant surface.

Figure 5:
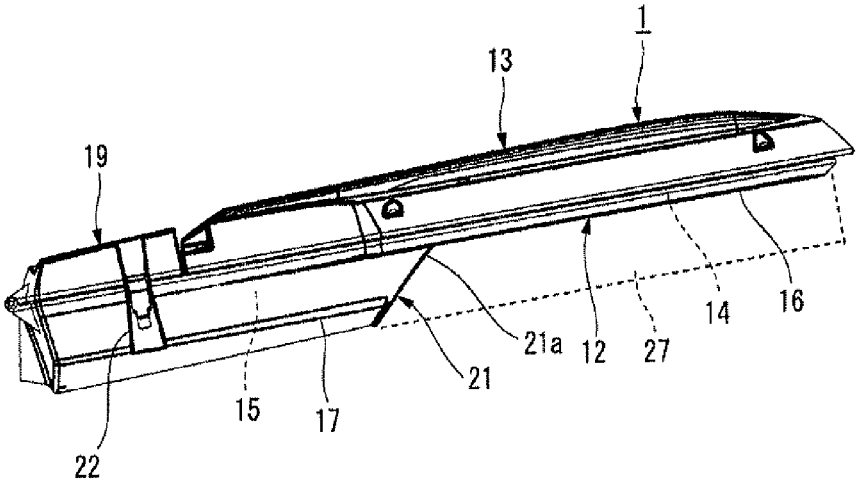
FIG. 5 is a view showing the omission portion of the LED light emitting part in the illumination device.

Further, as described above by referring to FIG. 4, the illumination device 1 is configured so that the thickness T1 of the section of the illumination device 1 where the LED light emitting part 14 exists becomes smaller than the thickness T2 of the section of the illumination device 1 where the power supply block 15 exists. This makes it possible to remove a portion 27 below the light emitting panel 16 surrounded by a dot line in FIG. 5, which reduces the size and the weight of the illumination device 1.

Figure 6:
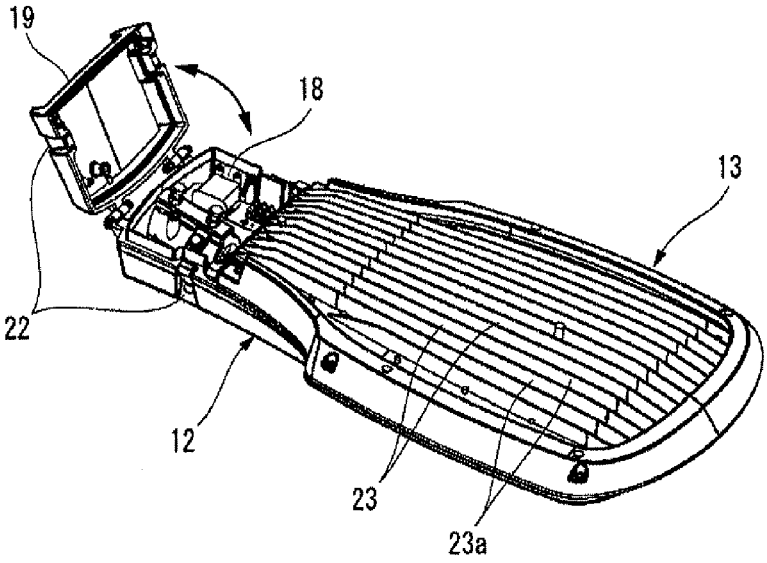
FIG. 6 is a view illustrating the released status of the covering member in the illumination device

Turning to FIG. 6, a latch mechanism 22 for locking and releasing the covering member 19 is provided at the covering member 19 and the main body 22. The wire-connecting space 18 can be opened by releasing the covering member 19 with the latch mechanism 22.

The radiation fins 23 are provided on the entire top surface of the upper cover portion 13. The grooves defined between the adjacent radiation fins 23 are formed to slant downward toward the peripheral edge of the upper cover portion 13. In the present embodiment, the radiation fins 23 extend along the longitudinal direction of the upper cover portion 13 and are arranged in a mutually parallel relationship.

Figure 7:
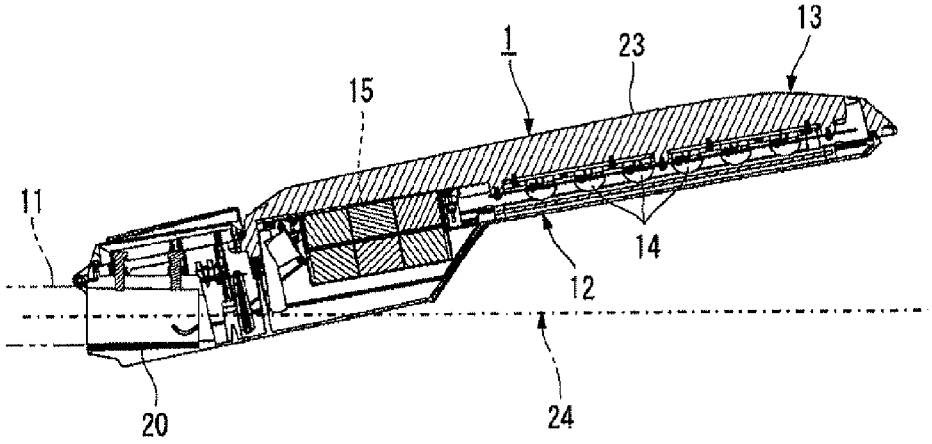
FIG. 7 is a view illustrating the attachment posture of the illumination device.

When the arm 11 is inserted into the arm insertion portion 20 as illustrated in FIG. 7, the illumination device 1 is obliquely attached to the arm 11 at a specific angle with respect to the horizontal surface 24 in such a way that the portion of the device 1 near the arm 11 can be positioned at the lower side and the portion of the device 1 carrying the LED light emitting part 14 is located at the upper side.

Figure 8A:
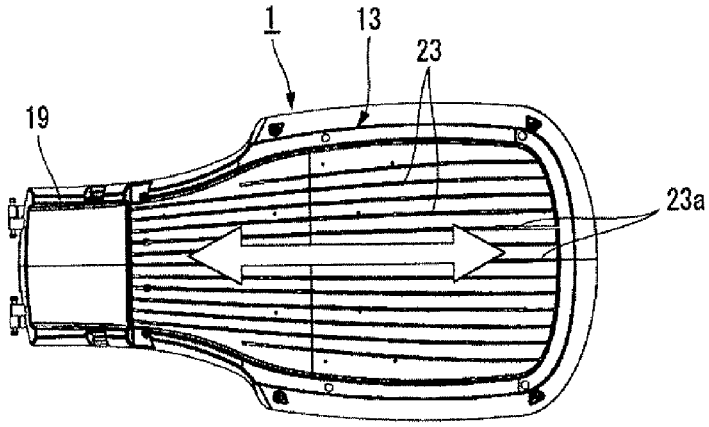
FIG. 8A is a view showing the radiation fins in the illumination device.
Figure 8B:
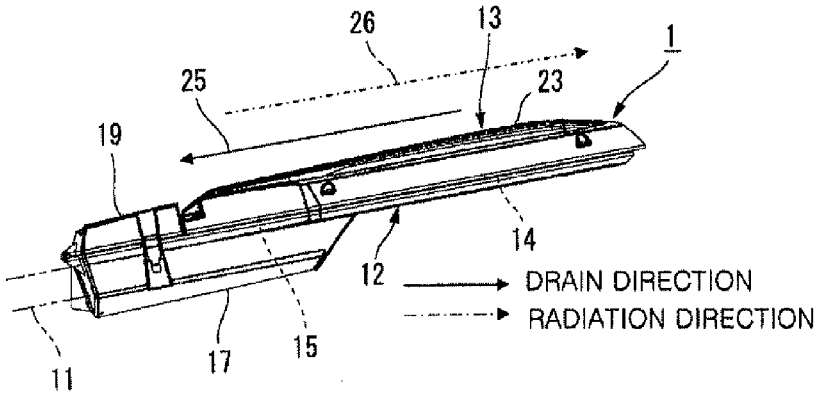
FIG. 8B is a view depicting the water draining direction and the heat radiating direction in the illumination device.
Figure 8C:
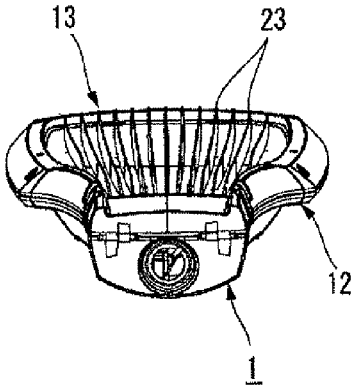
FIG. 8C is a side view of the illumination device shown in FIG. 8B.

As a result, the grooves 23*a* defined between the adjacent radiation fins 23 are inclined downward from the side of the LED light emitting part 14 to the side of the arm 11. Therefore, as shown in FIGS. 8A through 8C, the water such as rainwater or the like falling on the upper cover portion 13 is drained along the grooves 23*a* between the adjacent radiation fins 23 in the drain direction 25 indicated by a solid-line arrow in FIG. 8B. The heat generated in the illumination device 1 is radiated through the radiation fins 23 in the radiation direction 26 indicated by a single-dot-chain-line arrow in FIG. 8B. Accordingly, it is possible to perform the water drainage and the heat radiation in an efficient manner.

Figure 9:
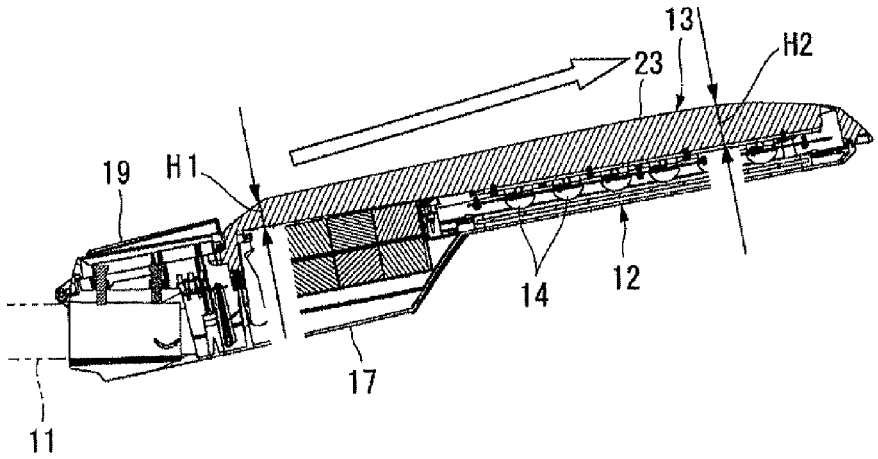
FIG. 9 is a view depicting the height of the radiation fins in the illumination device.

Referring to FIG. 9, the height of the radiation fins 23 is set to satisfy the inequality of H1<H2, where the H1 denotes the height of the radiation fins 23 at the side of the arm 11 and the H2 signifies the height of the radiation fins 23 at the side of the LED light emitting part 14. This makes it possible to further increase the heat radiation efficiency. Since the LED light emitting part 14 is arranged away from the arm 11, the heat radiation is further improved.

With the illumination device 1 in accordance with the first embodiment of the present invention, the water drainage and the heat radiation can be enhanced because the grooves 23*a* between the adjacent radiation fins 23 are inclined downward toward the peripheral edge of the upper cover portion 13.

Since the main body 12 is arranged to slant downward toward the arm 11 and the radiation fins 23 extend toward the arm 11 (namely, in the longitudinal direction of the upper cover portion 13), the water drainage and the heat radiation are further improved.

The heat radiation is further improved because the LED light emitting part 14 is arranged away from the arm 11.

(Second Embodiment)

Figure 10:
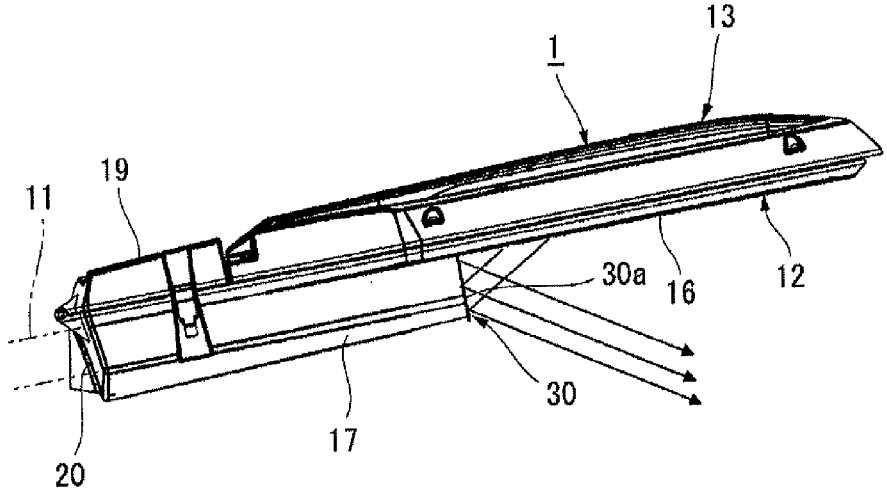
FIG. 10 is a view showing a light control function unit in an illumination device.

FIG. 10 shows a light control function unit 30 in an illumination device in accordance with the second embodiment of the present invention. In the following description, the same components as in the first embodiment will be designated by like reference numerals but will not be described in detail.

The light control function unit 21 includes a reflective surface 30*a* substantially perpendicular to the light emitting panel 16. A coating with high reflectivity is applied on the reflective surface 30*a*. The reflective surface 30*a* reflects the light coming from the light emitting panel 16 in the forward direction (namely, in the opposite direction to the arm 11). This makes it possible to direct the light forwards.

(Third Embodiment)

Figure 11:
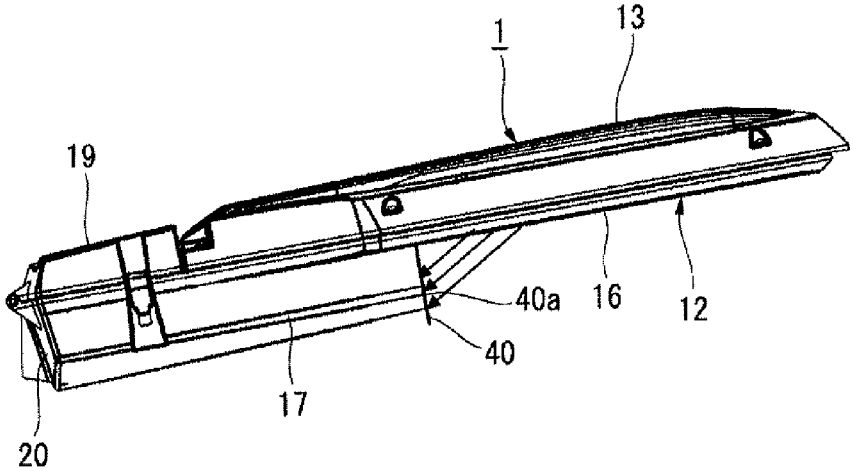
FIG. 11 is a view showing a light control function unit in an illumination device.

FIG. 11 shows a light control function unit 40 in an illumination device in accordance with the third embodiment of the present invention. The light control function unit includes a non-reflective surface 40*a* substantially perpendicular to the light emitting panel 16. A coating with low reflectivity is applied on the non-reflective surface 40*a*. Accordingly, the non-reflective surface 40*a* is restrained from reflecting the light coming from the light emitting panel 16 in the forward direction. This makes it possible to realize back-cut light distribution.

While the invention has been shown and described with respect to the embodiments, it will be understood by those skilled in the art that various changes and modification may be made without departing from the scope of the invention as defined in the following claims.

What is claimed is:

1. An illumination device, comprising:

a main body supported by a support member;

an upper cover portion covering an upper portion of the main body; and an LED light emitting part and a power supply unit, both of which are fixed to a lower side of the upper cover portion, the power supply unit being disposed between the support member and the LED light emitting part, wherein the upper cover portion includes a plurality of radiation fins provided on a top portion thereof and a plurality of grooves defined between adjacent radiation fins, the grooves being inclined downward toward the support member, and wherein a height of the radiation fins at a side where the LED light emitting part resides is greater than a height of the radiation fins at a side where the power supply unit exits;

wherein a thickness of a section of the illumination device where the LED light emitting part exists is smaller than a thickness of a section of the illumination device where the power supply unit exists; and a power supply containing unit protruding downward from the main body to contain the power supply unit therein and a light emitting panel provided at a lower side of the main body, wherein the power supply containing unit has an outer surface controlling light distribution of the light coming from the light emitting panel.

2. The illumination device of claim 1, wherein the main body is arranged to slant downward toward the support member and the radiation fins extend toward the support member.

3. The illumination device of claim 1 wherein the outer surface is a reflective surface substantially perpendicular to the light emitting panel.

4. The illumination device of claim 1 wherein the outer surface is a non-reflective surface substantially perpendicular to the light emitting panel.

* * * * *